US009476276B2

(12) United States Patent
Wells et al.

(10) Patent No.: US 9,476,276 B2
(45) **Date of Patent: *Oct. 25, 2016**

(54) METHOD FOR INSTALLING AND OPERATING A CABLE HEAD WITH CABLE SHEAR MECHANISM FOR WIRELINE CABLE SUPPORTING OILFIELD EQUIPMENT IN A WELLBORE

(71) Applicant: G&H DIVERSIFIED MANUFACTURING, LP, Houston, TX (US)

(72) Inventors: Joe Noel Wells, Houston, TX (US); Edward Cannoy Kash, Houston, TX (US)

(73) Assignee: G&H DIVERSIFIED MANUFACTURING, LP, Houston, TX (US)

( * ) Notice: Subject to any disclaimer, the term of this patent is extended or adjusted under 35 U.S.C. 154(b) by 312 days.

This patent is subject to a terminal disclaimer.

(21) Appl. No.: 14/037,043

(22) Filed: Sep. 25, 2013

(65) Prior Publication Data

US 2015/0083436 A1 Mar. 26, 2015

(51) Int. Cl.
*E21B 29/04* (2006.01)

(52) U.S. Cl.
CPC ..... *E21B 29/04* (2013.01)

(58) Field of Classification Search
USPC ..... 166/376, 54.5
See application file for complete search history.

(56) References Cited

U.S. PATENT DOCUMENTS

| | | | | | |
|---|---|---|---|---|---|
| 969,755 | A * | 9/1910 | Spang | E21B 29/04 | 166/54.6 |
| 3,312,283 | A * | 4/1967 | Yetman | E21B 23/03 | 166/136 |
| 3,926,252 | A * | 12/1975 | Ribeyre | E21B 29/04 | 114/221 A |
| 4,738,312 | A * | 4/1988 | Wittrisch | E21B 29/04 | 166/54.5 |
| 4,746,246 | A * | 5/1988 | Cowan | B63B 21/60 | 166/339 |
| 4,886,115 | A * | 12/1989 | Leggett | E21B 33/072 | 166/217 |
| 6,805,197 | B2 * | 10/2004 | Brumley | E21B 29/04 | 166/298 |
| 7,422,055 | B2 * | 9/2008 | Cruickshank | E21B 29/04 | 166/54.5 |
| 8,336,612 | B2 | 12/2012 | Robertson et al. | | |
| 8,376,040 | B2 | 2/2013 | Birkeland et al. | | |
| 2005/0230115 | A1 * | 10/2005 | Rose | E21B 31/00 | 166/301 |
| 2012/0018142 | A1 * | 1/2012 | Spence | E21B 17/023 | 166/77.1 |

* cited by examiner

*Primary Examiner* — Taras P Bemko
(74) *Attorney, Agent, or Firm* — Buskop Law Group, PC; Wendy Buskop

(57) ABSTRACT

A method for installing and operating a cable head with cable shear mechanism for wireline cable supporting oilfield equipment in a wellbore. The cable head has a housing, a cable bore, a tapered sleeve, a sliding bell, a drive pinch cylinder, a linear biasing mechanism positioned between the tapered sleeve and the drive pinch cylinder, a plurality of shear pins disposed partially into the housing and though the drive pinch cylinder, wherein each shear pin is adapted to withstand from 100 pounds to 2000 pounds of shear load, a pair of slidable cutting segments, and a pair of slidable cutting segment guides. When cable load exceeds a preset limit, the shear pins shear allowing the slidable cutting segments to be moved up the slidable cutting segment guides to impact and shear the cable.

19 Claims, 7 Drawing Sheets

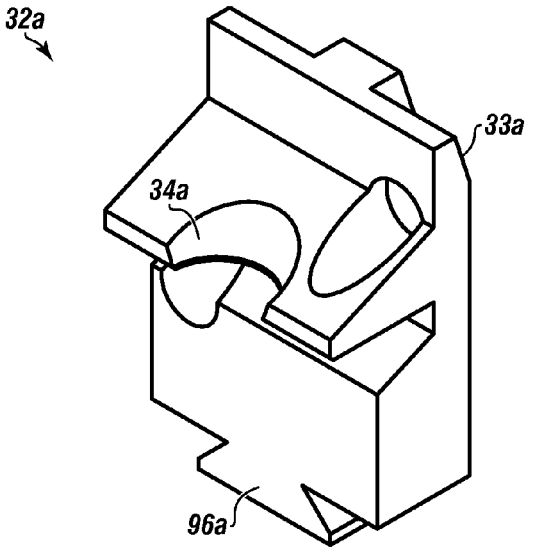
FIGURE 5A
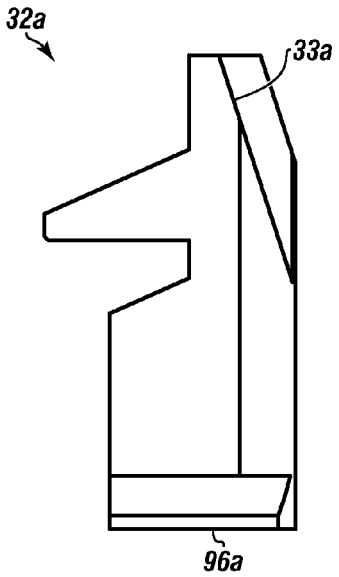
FIGURE 5B
FIGURE 6
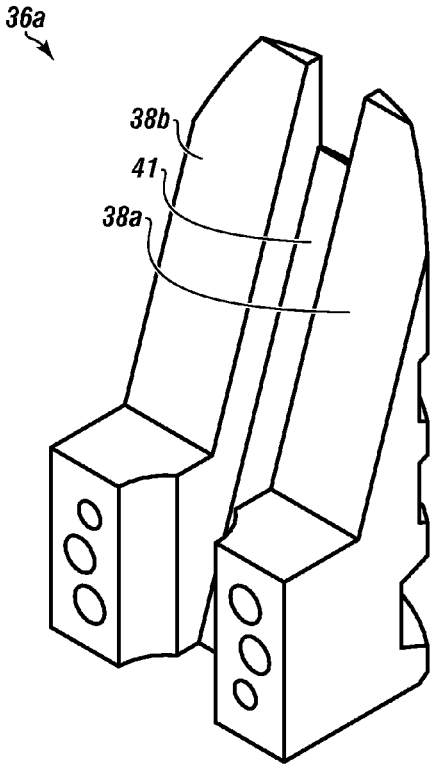

FIGURE 8

| | |
|---|---|
| THREADING THE UPPER HOUSING ONTO A CABLE END OF A WIRE LINE CABLE | 800 |
| FORMING AN ASSEMBLY OF A PAIR OF SLIDABLE CUTTING SEGMENT GUIDES FORMED IN A SLIDING FIT WITH SLIDABLE CUTTING SEGMENTS AND THE DRIVE PINCH CYLINDER, AS WELL AS RADIALLY BIASED SPRING MECHANISMS BETWEEN THE SLIDABLE CUTTING SEGMENTS | 802 |
| INSERTING THE ASSEMBLY FORMED IN STEP 802 INTO A LOWER HOUSING AND ALIGNING THE SHEAR PIN BORE HOLES WITH MATCHING HOUSING HOLES IN THE HOUSING | 803 |
| INSERTING SHEAR PINS INTO THE ALIGNED HOLES THROUGH THE LOWER HOUSING INTO SHEAR PIN BORE HOLES AND INTO THE DRIVE PINCH CYLINDER OF THE ASSEMBLY | 804 |
| THREADING THE UPPER HOUSING ONTO THE LOWER HOUSING AND TORQUED TO FORM A TIGHT FIT | 806 |
| INSERTING LINEAR BIASING MECHANISM AND DISC INTO THE LOWER HOUSING ON ITS OPEN NON-THREADED END, AS THE LOWER HOUSING IS TUBULAR | 808 |
| THREADING THE TAPERED SLEEVE INTO THE CABLE END SO THAT UPPER SLEEVE PORTION IS ORIENTED OPPOSITE THE CABLE END | 810 |
| PASSING THE CABLE END THROUGH THE SLIDING BELL | 811 |
| TAKING CABLE END AND UNWINDING THE CABLE END INTO CABLE STRANDS | 812 |
| POSITIONING THE CABLE STRANDS AROUND THE SLIDING BELL'S LOWER BODY AND INSERTING THE ENDS OF THE UNWOUND CABLE STRANDS THROUGH THE BELL HOLES IN THE BELL TOP FACE OF THE SLIDING BELL | 814 |
| PULLING CABLE TO REMOVE ALL SLACK IN THE CABLE FROM THE CABLE HEAD COMPONENTS INCLUDING THE SLIDING BELL AND CAUSING THE SLIDING BELL TO SLIDE INTO THE TAPERED SLEEVE AND SEAT TIGHTLY TO POSITION THE SLIDABLE CUTTING SEGMENTS IN AN OPEN NON CUTTING ORIENTATION AROUND THE WIRE LINE CABLE | 816 |
| ATTACHING THE COMBINATIONS OF THE WIRE LINE CABLE WITH ATTACHED CABLE HEAD WITH CABLE SHEAR MECHANISM TO A TOOL STRING OF A VARIETY OF DIFFERENT TOOL ELEMENTS FOR USE DOWN HOLE IN A WELL | 818 |

FIGURE 9

| | |
|---|---|
| APPLYING A LOAD TO THE WIRE LINE CABLE FROM THE SURFACE | 900 |
| PULLING THE SLIDING BELL INTO THE TAPERED SLEEVE | 902 |
| ALLOWING THE CABLE LOAD ON THE TAPERED SLEEVE TO URGE THE LINEAR BIASING MECHANISM TO PUSH ON THE DRIVE PINCH CYLINDER TO BREAK A PLURALITY OF SHEAR PINS INSTALLED IN THE DRIVE PINCH CYLINDER | 904 |
| ALLOWING THE CABLE LOAD TO CONTINUE TO SUPPLY PRESSURE TO THE DRIVE PINCH CYLINDER TO SLIDE A PAIR OF SLIDABLE CUTTING SEGMENTS TOWARD THE TAPERED NOSE ALONG A PAIR OF SLIDABLE CUTTING SEGMENT GUIDES | 906 |
| ALLOWING CUTTING FACES OF THE PAIR OF SLIDABLE CUTTING SEGMENTS TO IMPACT THE WIRE LINE CABLE AND ORIENT FROM AN OPEN POSITION TO A CLOSED POSITION CUTTING THE CABLE AND ALLOWING THE CABLE HEAD WITH SHEAR CUTTING MECHANISM TO BE PULLED OUT OF THE WELLBORE WHILE DETACHING FROM OIL FIELD EQUIPMENT LEFT IN THE WELLBORE | 908 |

METHOD FOR INSTALLING AND OPERATING A CABLE HEAD WITH CABLE SHEAR MECHANISM FOR WIRELINE CABLE SUPPORTING OILFIELD EQUIPMENT IN A WELLBORE

FIELD

The present embodiments generally relate to a method for installing and using a cable head with cable shear mechanism on a wireline cable to support oilfield equipment in a wellbore.

BACKGROUND

A need exists for a method to support oilfield equipment in a wellbore that is also capable of shearing the cable supporting that equipment, particularly when the equipment is well perforating guns.

A need exists for a method to install and operate a cable head with a cable shear mechanism on a wireline cable or to other cable prior to running in hole until the downhole equipment becomes stuck in the wellbore and the need arises to shear one or more strands of the wireline cable.

The present embodiments meet this need.

BRIEF DESCRIPTION OF THE DRAWINGS

The detailed description will be better understood in conjunction with the accompanying drawings as follows:

FIG. 5A is a top perspective view of a slidable cutting segment usable in the method.

FIG. 5B is a side view of the slidable cutting segment of FIG. 5A.

FIG. 6 is an isometric view of a slidable cutting segment guide usable in the method.

FIG. 8 is a diagram of the steps of the method to install the cable head with cable shear mechanism.

FIG. 9 is a diagram of the steps of the method to operate the installed cable head with cable shear mechanism according to the invention.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

This invention provides a method for installing and using a cable head with shear cutting mechanisms versatile for a variety of diameter wireline cables.

This invention provides a method for clean shearing of a wireline cable for easy retrievable of the wireline cable and the oilfield tool left in the well, such as a well perforating gun, a well logging tool, or a setting tool.

This invention provides a method for shearing wireline cable that can be repeated with the same cable head.

This invention provides a method that allows an oilfield worker with minimal training to install and selectively cut wireline cable attached to a downhole tool that has been run into a wellbore.

This invention provides a method that can reduce having accidents at a drilling rig, a drilling site, or at a wellbore, due to premature or unexpected disconnect of cable between a downhole tool string and a wireline cable.

The invention provides a method that can reduce accidents occurring at a well site when a highly frayed wireline cable accelerates out of the wellbore unexpectedly causing oilfield tools to fall on rig personnel with the strong possibility that the accident might cause loss of a limb or possible death.

This invention provides for a method that can prevent explosions at a rig site by enabling rig hands to quickly and efficiently cut cable thereby minimizing well perforating gun explosive charges from detonating prematurely or accidently.

Figure 1A:
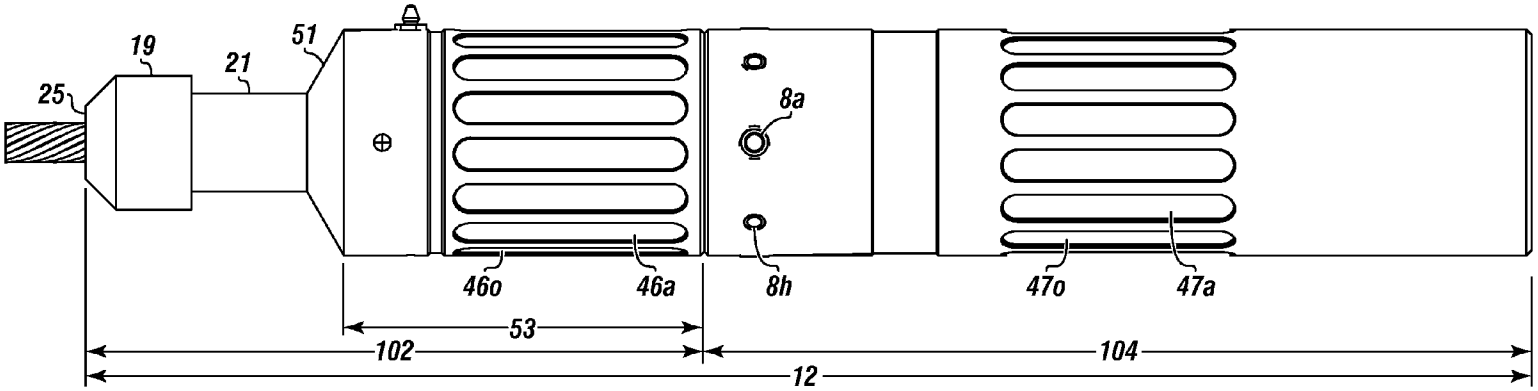
FIG. 1A is a perspective view of a cable head with cable shear mechanism usable in the method.
Figure 1B:
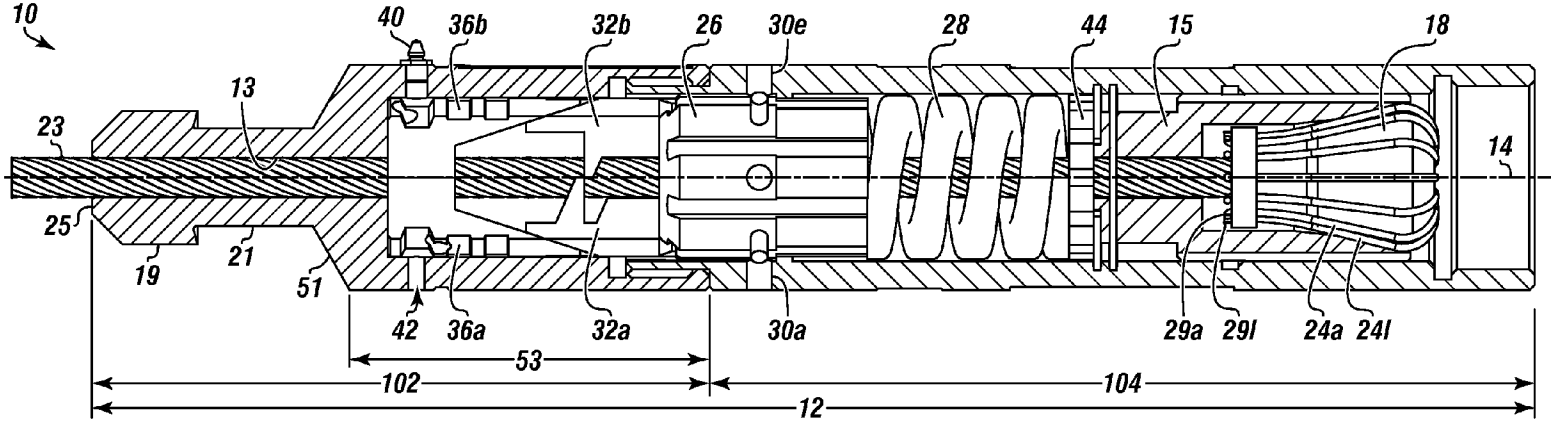
FIG. 1B is a cut away view of the cable head with cable shear mechanism usable in the method.

Turning now to the Figures, FIG. 1A is a side view of a cable head with cable shear mechanism. FIG. 1B is a cut away view of the cable head with the cable shear mechanism.

The cable head with the cable shear mechanism 10 is shown with a housing 12.

The housing 12 can be made from alloy steel, such as AISI 4330 steel. In embodiments the housing can be plated with a second material to provide additional durability, reduction of static charge build up, corrosion resistance or another material benefit such as improved surface wear. The second material can be disposed on the cable head at a thickness from 0.0005 inches to 0.005 inches.

FIGS. 1A and 1B show the housing as a two part housing with an upper housing 102 and a lower housing 104. In one or more embodiments, the upper housing and the lower housing can be threaded together.

In embodiments, the housing 12 can be formed as a one piece unit, or can be assembled from multiple components.

The upper housing 102 can have an outer diameter from 1 and ⅜ inches to 2 and ¾ inches.

The upper housing 102 in FIG. 1B is depicted with a grease loading port 40 which allows grease to be inserted through the housing 12 around components of the cable head of the cable shear mechanism. A grease excess outlet 42 allows grease to exit the housing when the body portion is full of grease.

The upper housing 102 mounts around a pair of slidable cutting segment guides 36*a* and 36*b* that guide slidable cutting segments 32*a* and 32*b* as the slidable cutting segments slide toward the upper housing 104 to cut strands of a wireline cable 23.

The upper housing 102 has sloped shoulders 51 and an upper housing body portion 53. The upper housing body portion 53 can have an identical outer diameter to the body portion of the cable head with the cable shear mechanism.

The sloped shoulders 51 can be formed at an angle from 85 degrees to 30 degrees from a central axis 14.

In embodiments, the housing 12 can have a cable bore 13, which can be centrally disposed and seen in FIG. 1B. The cable bore 13 is shown having a central axis 14.

The cable bore can have a diameter from 0.25 inches to 1 inch, or the cable bore can have a constant diameter.

The device can have a tapered nose 19 with a flat face 25. A top shaft 21 can connect to a tapered nose 19.

In one or more embodiments, the sloped shoulders 51 can slope in the same direction as the tapered nose 19 but at a different angle. In other embodiments, the sloped shoulders 51 sloping in the same direction as the tapered nose 19 can extend toward the top shaft 21 and can be a portion of the upper housing 102.

In one or more embodiments, the upper housing 102 can be made from the same material as the tapered nose and top shaft.

The tapered nose 19 aids removal of the cable head from the wellbore.

The tapered nose 19 can be formed at an angle from 30 degrees to 60 degrees from the central axis 14.

The tapered nose can have an outer diameter at its largest circumference from 1 inch to 2 inches. The tapered nose 19 can be made from a strong material such as AISI 4330 or steel that is resistant to deformation at pressure from 1 to 20,000 pounds per square inch (psi), such as steel AISI 4130.

The flat face 25 of the tapered nose can be formed perpendicular to the central axis 14. The flat face can have the initial opening of the cable bore 13 for receiving the wireline cable 23.

The flat face can have an outer diameter from 0.5 inches to 2 inches, or from 2 percent to 50 percent smaller in diameter than the largest outer diameter of the tapered nose The cable bore extends from the flat face through the entire tapered nose.

In embodiments, the cable bore 13 can extend from the flat face 25, through the tapered nose 19, through the top shaft 21, through the upper housing 102 and into the lower housing 104.

The top shaft 21 can have an outer diameter less than the outer diameter of the tapered nose. In embodiments, the outer diameter of the top shaft can be from 0.76 inches to 2 inches. The top shaft can be made from the same material as the tapered nose. The top shaft can have a central bore that is equal to the diameter of the cable bore of the tapered nose.

In embodiments, the top shaft can have an outer diameter less than the outer diameter of the tapered nose at the widest portion of the tapered nose.

A plurality of first flutes 46*a*-46*o* can be seen in the body portion of the side view of the cable head with cable shear mechanism. The plurality of first flutes can be formed on an outer surface of the body portion.

The plurality of first flutes 46*a*-46*o* can have an elliptical shape allowing for better tool gripping than smooth sided cable heads.

A plurality of second flutes 47*a*-47*o* can be disposed on an exterior portion of the body portion and spaced apart from the plurality of first flutes.

In embodiments, individual flutes each have a depth from 0.01 inches to 0.06 inches and length from 1.25 inches to 1.50 inches.

In embodiments, the individual first and second flutes can be formed equidistantly around the body portion.

In embodiments from 6 to 18 first flutes and second flutes can be used.

Housing holes 8*a*-8*h* can be formed in the housing which can be aligned with shear pin bore holes in a drive pinch cylinder, as shown in FIG. 1A.

Figure 3C:
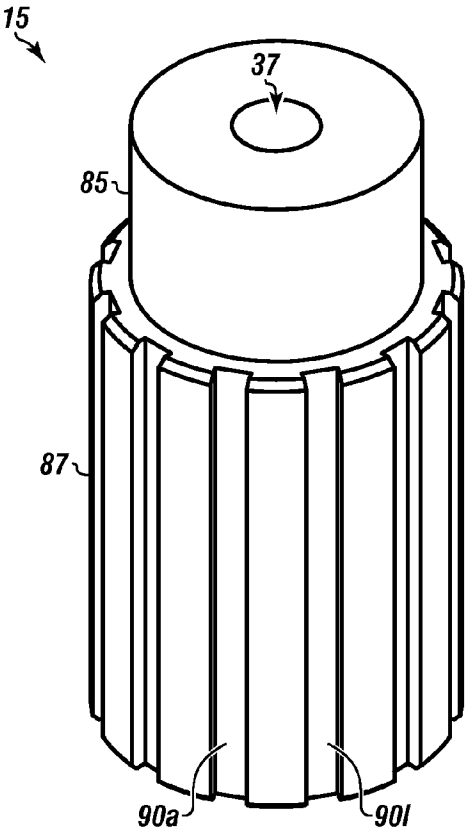
FIG. 3C is a perspective view of a tapered sleeve according to the embodiments.
Figure 3B:
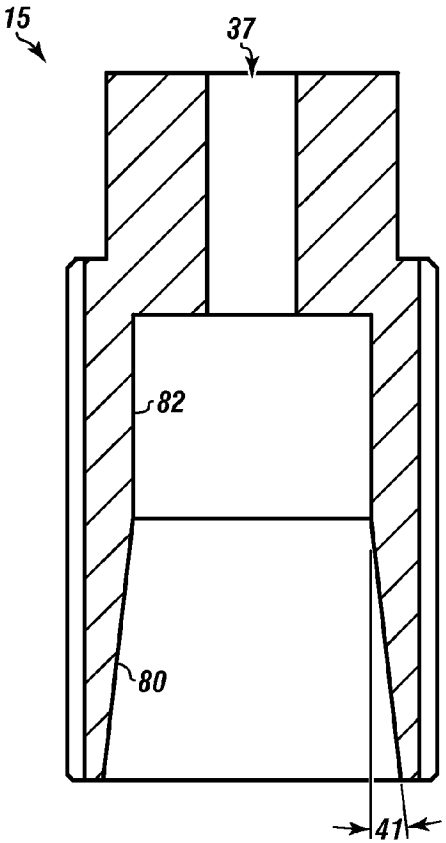
FIG. 3B is a cross section of a tapered sleeve according to the embodiments.
Figure 3A:
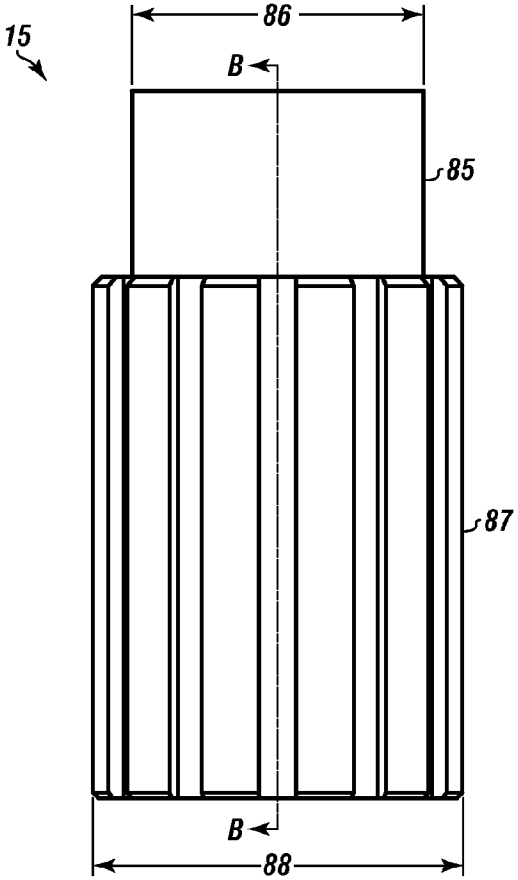
FIG. 3A is a side view of the tapered sleeve usable in the method.

A sliding bell 18 is shown in the lower housing 104 that slides into and engages a tapered sleeve 15, as shown in FIG. 1B and is depicted in more detail in FIGS. 3A and 3B.

Figure 2C:
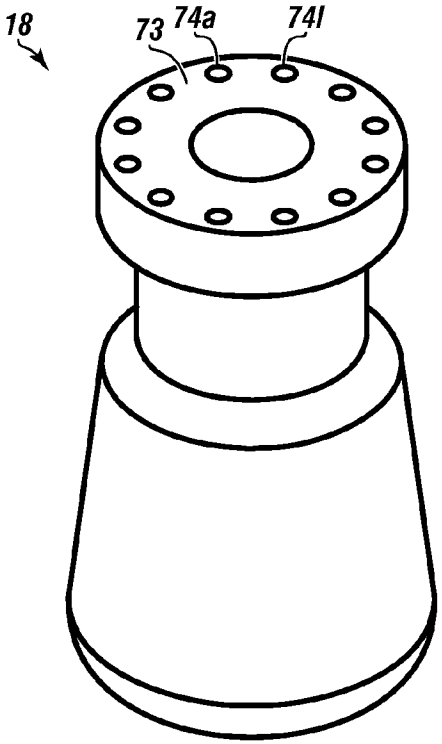
FIG. 2C is a top perspective view of the sliding bell according to the embodiments.
Figure 2B:
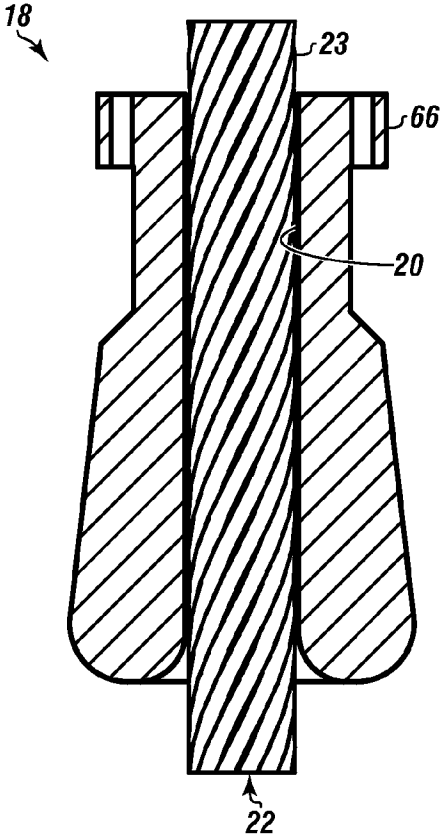
FIG. 2B is cross section view of the sliding bell according to the embodiments.
Figure 2A:
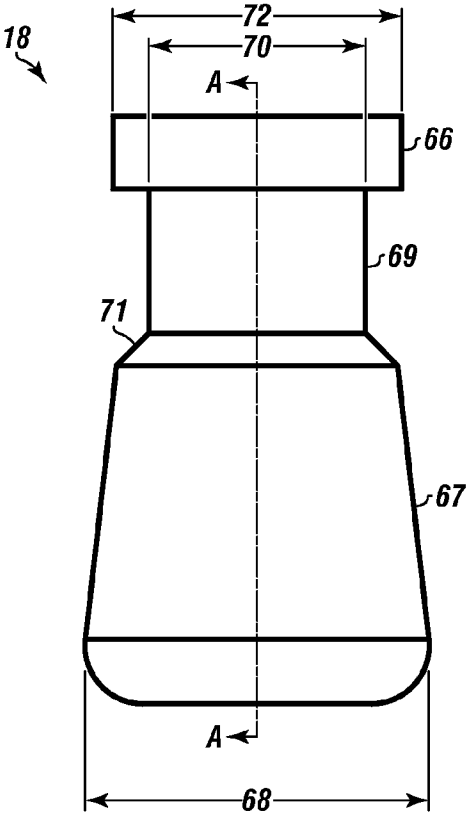
FIG. 2A is a side view of the sliding bell usable in the method.

The sliding bell is depicted in more detail in FIGS. 2A, 2B, and 2C and viewing those figures with FIG. 1B aids in achieving full understanding of the sliding bell.

Cable strands 24*a*-241 that have been unwound from a wireline cable 23 can be oriented around the sliding bell 18 with cable ends 29*a*-29*i* just peeking up from the surface of the top of the sliding bell 18.

The sliding bell 18 slides towards the tapered nose 19 when the wireline cable 23 is pulled toward the surface of the wellbore.

As the wireline cable 23 is pulled, the sliding bell 18 slides into tapered sleeve 15 within the housing 12.

A linear biasing mechanism 28 contained in the housing is pushed by the tapered sleeve 15 when the wireline cable 23 is pulled. In this embodiment, the linear biasing mechanism 28 is shown as a spring.

In embodiments when the linear biasing mechanism 28 is a spring the spring is a helically wound rectangular wire forming the spring with the wire width of 0.25 to 0.5 inches and a wire height of 0.125 inches to 0.375 inches and the wire can be made from chrome silicon spring steel.

In embodiments, the linear biasing mechanism is adapted to support at least 800 pounds.

In embodiments, the linear biasing mechanism can have an outer diameter to fit within the lower housing 104 of the housing 12 and slide within the lower housing 104 to push a drive pinch cylinder 26.

The linear biasing mechanism in embodiments can have a width from 1.25 inches to 1.75 inches in diameter.

When the sliding bell 18 slides up into the tapered sleeve 15, and stops, the linear biasing mechanism 28 is urged in the direction of the tapered nose 19 by the tapered sleeve 15.

The linear biasing mechanism applies pressure or a load in the direction of the tapered nose to push against the drive pinch cylinder 26 in the housing.

The drive pinch cylinder 26 is held into the housing by a plurality of shear pins 30*a*-30*e*.

In embodiments, from 1 to 8 shear pins can straddle the housing and the drive pinch cylinder at the point of contact.

In embodiments, each shear pin can have a diameter from 0.125 inches to 0.5 inches.

In embodiments a first group of the shear pins can have a first diameter, and a second group of the shear pins can have a different second diameter.

In embodiments a third group of the shear pins can have a third diameter different from the first and second diameters.

In embodiments, the shear pins, can each have a length from ⅜ inch to ¾ inch.

In embodiments, the shear pins can extend a pin length from 50 percent to 80 percent into the drive pinch cylinder 26.

In embodiments, the shear pins can be selected from any material possessing the necessary shear strength. For example, the shear pins can be a non-porous high silica ceramic, carbides, a combination of ceramic and glass, or appropriate metals such as steel, brass, aluminum, copper, or alloys of these metals, such as bronze.

In other embodiments the shear pins can comprise polymer materials such as polyolefin shear pins made from crystalline poly-alpha olefins.

The cable load causes the shear pins to break, allowing the drive pinch cylinder to move in the direction of the tapered nose.

The drive pinch cylinder 26 pushes the slidable cutting segments 32*a* and 32*b* into the aforementioned pair of slidable cutting segment guides 36*a* and 36*b*, causing the cutting faces of each moveable slidable cutting segment to come together towards each other thereby cutting some or all of the strands of the wireline cable 23.

A sliding disc 44 is also shown, which can be positioned between the sliding bell 18 and the linear biasing mechanism 28 to provide a smoother and constant load surface for the linear biasing mechanism to seat against the tapered sleeve 15.

FIG. 2A depicts the sliding bell 18 having a bell lower portion 67 with a lower outer diameter 68 that tapers from the portion of the sliding bell that allows the cable end 22, shown in FIG. 2B, to exit the sliding bell towards a bell middle portion 69.

The bell middle portion has bell shoulders 71 that taper in the same direction as the tapered nose and away from the bell lower portion 67 towards the bell middle portion 69.

In this embodiment, the bell middle portion can be cylindrical with a constant diameter.

The bell middle portion 69 engages bell top 66. The bell top has a bell top outer diameter 72 that is larger than a bell middle outer diameter 70 by 10 percent to 40 percent.

The bell middle outer diameter 70 is shown to be smaller than the bell top outer diameter 72 by 10 percent to 40 percent and is also shown smaller than the lower outer diameter 68 and the bell top outer diameter 72.

The bell lower outer diameter 68 has an outer diameter from 0.75 inches to 1.5 inches in embodiments.

The reason for this configuration is to provide a tapered mating surface with the tapered sleeve.

In one or more embodiments, the sliding bell 18 can be a one piece integral structure.

FIG. 2B depicts the sliding bell 18 having a sliding bell cable bore 20 for receiving wireline cable 23 and allowing a cable end 22 to exit the sliding bell cable bore. The bell top 66 can also be viewed.

When cable load exceeds a preset limit, the sliding bell moves towards the linear biasing mechanism, the linear biasing mechanism moves the drive pinch cylinder causing the shear pins to shear allowing the slidable cutting segments to move up the pair of slidable cutting segment guides toward the tapered nose to impact and shear all or portions of the wireline cable.

FIG. 2C is a top perspective view of the sliding bell 18. The sliding bell has bell holes 74*a*-741 formed through bell top face 73 which can be a flat planar face in this embodiment.

Each bell hole 74*a*-741 receives a cable strand from around the bell lower portion. Each cable strand is unwound from wireline cable that forms the cable end.

In embodiments, the cable can have from 6 to 24 strands.

FIG. 3A is the perspective view of the tapered sleeve 15 having an upper sleeve portion 85 with an upper sleeve outer diameter 86 that is smaller than a lower sleeve outer diameter 88.

Also shown is an exterior of the lower sleeve portion 87 of the tapered sleeve 15 with a plurality of slots labeled more clearly in FIG. 3C.

FIG. 3B is a cross section of the tapered sleeve 15. The tapered sleeve 15 has an interior tapered surface 80 that connects to an interior constant diameter surface 82 which are formed connected to a tapered sleeve cable bore 37.

In embodiments, the tapered sleeve has an interior tapered surface 80 sloped at an angle 41 from 5 degrees to 15 degrees from the central axis shown in FIG. 1B.

FIG. 3C is a perspective view showing the tapered sleeve cable bore 37 passing through the tapered sleeve 15 and the different diameters of the lower sleeve portion 87 versus the upper sleeve portion 85.

The plurality of slots 90*a*-901 are shown, wherein each slot extends the length of the lower sleeve portion 87 allowing grease to move by the part.

Figure 4B:
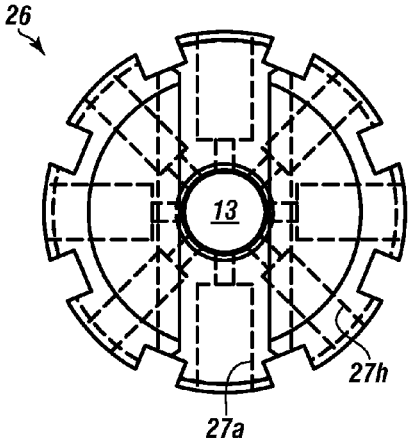
FIG. 4B is a top view of the drive pinch cylinder usable in the cable head with cable shear mechanism.
Figure 4C:
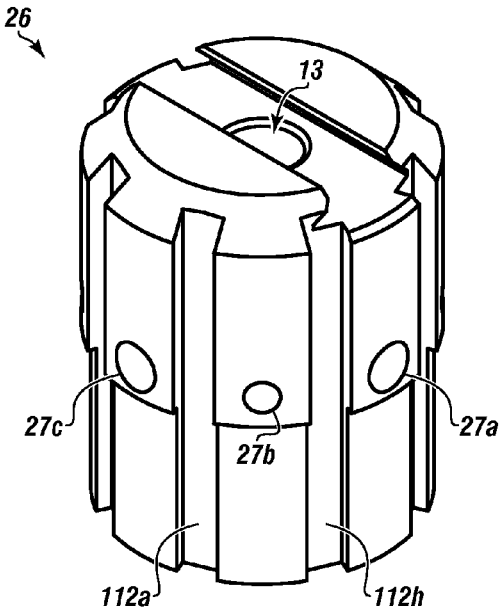
FIG. 4C is a perspective top view of the drive pinch cylinder usable in the cable head with cable shear mechanism.
Figure 4A:
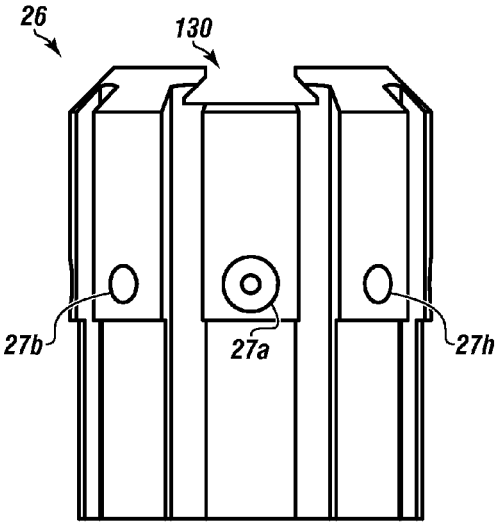
FIG. 4A is a front elevation of a drive pinch cylinder usable in the cable head with cable shear mechanism usable in the method.

FIGS. 4A, 4B and 4C show details of the drive pinch cylinder.

FIG. 4A is a side view of the drive pinch cylinder 26, with shear pin bore holes 27*a*, 27*b*, and 27*h* for receiving shear pins.

A dovetail guide 130 is also shown in this Figure.

FIG. 4B is a top view of the drive pinch cylinder 26. The shear pin bore holes 27*a*-27*h* can be seen disposed equidistantly around the central bore 13.

In embodiments, the drive pinch cylinder 26 can be tubular with an inner bore greater than a diameter of the wireline cable.

The drive pinch cylinder 26 slides toward the tapered nose when the wireline cable load causes the breaking of the shear pins.

The shear pins are only disposed partially into the housing and though the drive pinch cylinder 26 to a bottom of the shear pin bore holes.

Each shear pin is adapted to withstand from 100 pounds to 2000 pounds of shear load.

FIG. 4C depicts another embodiment of the drive pinch cylinder 26 having external grooves 112*a*-112*h* for allowing grease to pass the drive pinch cylinder and move easily in the housing.

In this embodiment, the diameters of the shear pin bore holes 27*a* and 27*c* differ in diameter than that of shear pin bore hole 27*b* and are shown disposed around the central bore 13. The bores can range in diameter from ⅛ inch in diameter to ½ inch in diameter.

The reason the shear pin bore holes have varying diameters in this embodiment is to enable the user to use shear pins with different diameters to maximize a range of available shear loads.

Figure 4D:
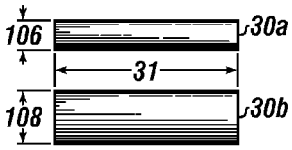
FIG. 4D is an isometric view of two shear pins usable in the method.

FIG. 4D is an isometric view of two shear pins 30*a* and 30*b* each shear pin having a different usable diameter depicted as first diameters 106 and second diameter 108 respectively.

In embodiments, each shear pin can have a different shear fracture load rating.

Each shear pin has a shear pin length 31 that can be constant.

FIG. 5A is a top perspective view of a slidable cutting segment 32*a* with a cutting face 34*a* and a sliding surface 33*a*.

The cutting face 34*a* is shown as semicircular or half-moon shaped.

An interlock member 96*a* is also shown and in embodiments can fit into the dovetail guide shown in FIG. 4A.

The sliding surface 33*a* fits smoothly into a sliding engagement in a sliding surface of the slidable cutting segment guide shown in FIG. 6.

FIG. 5B is a side view of the slidable cutting segment 32*a* with a sliding surface 33*a* and the interlock member 96*a*.

For each slidable cutting segment there is a sliding surface and a cutting face.

FIG. 6 is an isometric view of a slidable cutting segment guide 36*a* usable in the cable head with the cable shear mechanism.

The slidable cutting segment guide 36*a* is shown with two sliding guide surfaces 38*a* and 38*b*.

In embodiments, both slidable cutting segment guides can be identical to each other.

Each slidable cutting segment guide can accept the sliding surface of a slidable cutting segment.

A recessed groove 41 can be formed between the two sliding guide surfaces. The recessed groove 41 maintains alignment of slidable cutting segments 32*a* and 32*b* during assembly Each slidable cutting segment guide has a sliding guide surface formed at a sliding guide angle that is a complementary angle matching the slidable cutting segment angle, shown in FIG. 7, of the sliding segment sliding surface.

The sliding guide surfaces provide a flush engagement.

Figure 7:
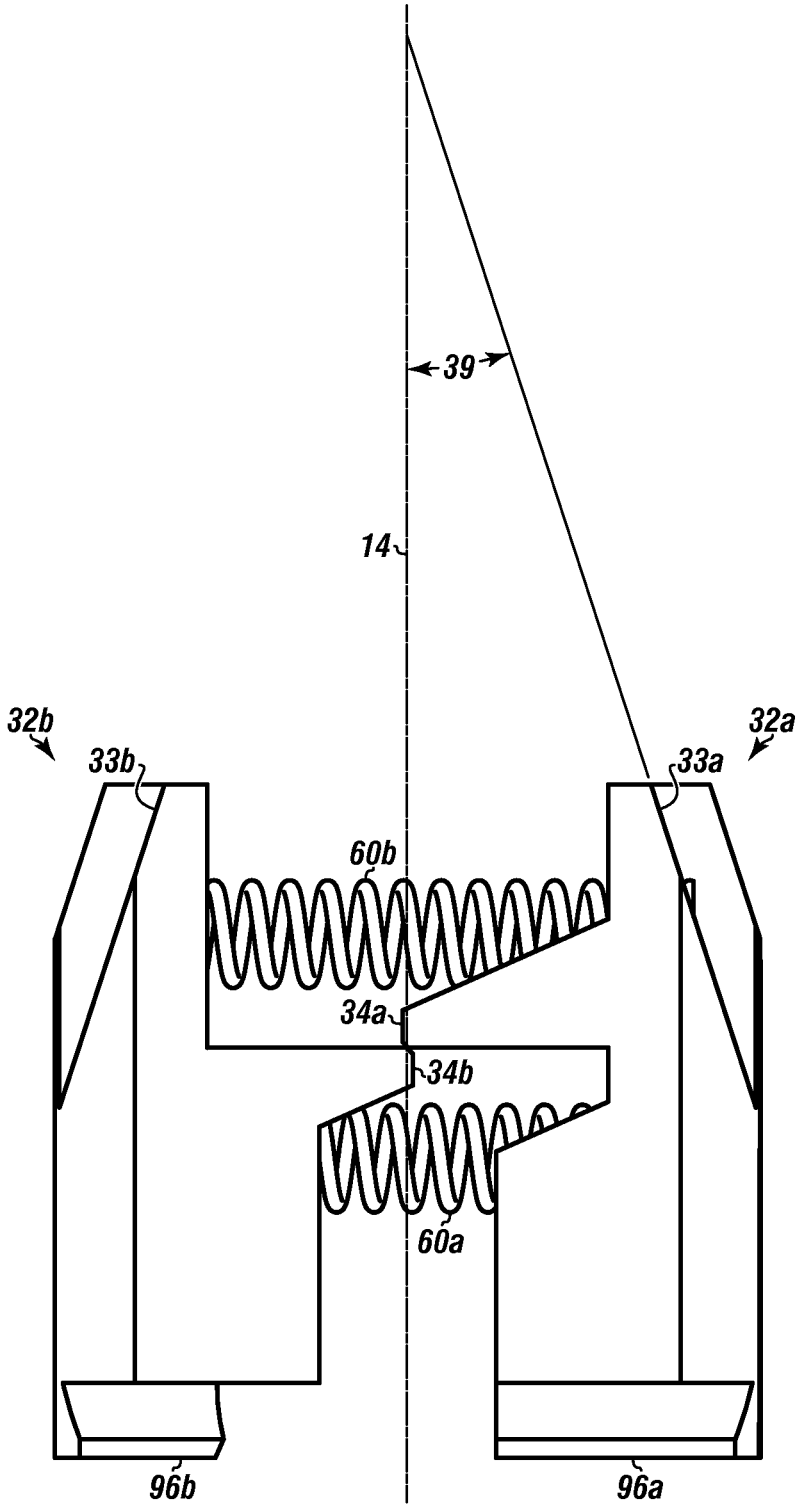
FIG. 7 is a front view of an embodiment of a pair of slidable cutting segments usable in the method.

FIG. 7 is a front perspective view of an embodiment of a pair of slidable cutting segments 32*a* and 32*b*. The pair of slidable cutting segments are shown with sliding surfaces 33*a* and 33*b* having an angle 39 with a slope from 10 degrees to 30 degrees from the central axis 14.

When the slidable cutting segments 32*a* and 32*b* are moved from an open non-cutting orientation to a closed cutting orientation (when cable load exceeds shear strength of the shear pin), the cutting faces 34*a* and 34*b* of the slidable cutting segments 32*a* and 32*b* impact and cut the wireline cable.

The slidable cutting segments 32*a* and 32*b* are held apart by a pair of radially biased spring mechanisms 60*a* and 60*b*. The cutting faces 34*a* and 34*b* are shown in a separated or open configuration prior to closing over a wireline cable to cut the cable.

A pair of interlock members 96*a* and 96*b* can be seen.

In embodiments, the housing has an upper housing threaded to a lower housing, wherein the upper housing contains the pair of slidable cutting segments and the pair of slidable cutting segment guides. The lower housing contains the tapered sleeve, the sliding bell, the drive pinch cylinder, the linear biasing mechanism, and the plurality of shear pins disposed partially into the housing and through the drive pinch cylinder into shear pin bore holes.

In this embodiment, each shear pin is adapted to withstand from 100 pounds to 2000 pounds of shear load.

FIG. 8 is a diagram of the steps of the method to assemble and install the cable head with cable shear mechanism usable for cutting wireline cable downhole.

The method can include threading the upper housing onto a cable end of a wireline cable, as shown in step 800. The tapered nose of the upper housing is oriented to face in a direction that is opposite the cable end.

The method can include forming an assembly of a pair of slidable cutting segment guides formed in a sliding fit with slidable cutting segments and the drive pinch cylinder, as well as radially biased spring mechanisms between the slidable cutting segments, as shown in step 802.

The method can include inserting the assembly formed in step 802 into a lower housing and aligning the shear pin bore holes with matching housing holes in the housing, as shown in step 803.

The method can include inserting shear pins into the aligned holes through the lower housing into shear pin bore holes and into the drive pinch cylinder of the assembly, as shown in step 804. The shear pins must be completely inserted to the bottom of the shear pin bore holes.

The method can include threading the upper housing onto the lower housing and torqued to form a tight fit, as shown in step 806. A pipe wrench can be used to torque the housing together. The torquing can be manual in an embodiment.

The method can include inserting linear biasing mechanism and disc into the lower housing on its open non-threaded end, as the lower housing is tubular, as shown in step 808.

The method can include threading the tapered sleeve into the cable end so that upper sleeve portion is oriented opposite the cable end, as shown in step 810.

The method can include passing the cable end through the sliding bell, as shown in step 811.

The method can include taking cable end and unwinding the cable end into cable strands, as shown in step 812.

The method can include positioning the cable strands around the sliding bell's lower body and inserting the ends of the unwound cable strands through the bell holes in the bell top face of the sliding bell, as shown in step 814.

The method can include pulling cable to remove all slack in the cable from the cable head components including the sliding bell and causing the sliding bell to slide into the tapered sleeve and seat tightly to position the slidable cutting segments in an open non cutting orientation around the wireline cable, as shown in step 816.

The method can include attaching the combinations of the wireline cable with attached cable head with cable shear mechanism to a tool string of a variety of different tool elements for use downhole in a well, as shown in step 818.

FIG. 9 provides the sequence of steps of the method to operate the cable head with cable shear mechanism installed according to step 818.

The method can include applying a load to the wireline cable from the surface, as shown in step 900.

The method can include pulling the sliding bell into the tapered sleeve, as shown in step 902.

The method can include allowing the cable load on the tapered sleeve to urge the linear biasing mechanism to push on the drive pinch cylinder to break a plurality of shear pins installed in the drive pinch cylinder, as shown in step 904.

The method can include allowing the cable load to continue to supply pressure to the drive pinch cylinder to slide a pair of slidable cutting segments toward the tapered nose along a pair of slidable cutting segment guides, as shown in step 906.

The method can include allowing cutting faces of the pair of slidable cutting segments to impact the wireline cable and orient from an open position to a closed position cutting the cable and allowing the cable head with shear cutting mechanism to be pulled out of the wellbore while detaching from oilfield equipment left in the wellbore, as shown in step 908.

While these embodiments have been described with emphasis on the embodiments, it should be understood that within the scope of the appended claims, the embodiments might be practiced other than as specifically described herein.

What is claimed is:

1. A method for assembling a cable head with a cable shear mechanism to cut wireline cable supporting oilfield equipment in a wellbore, the method comprising:

a. threading an upper housing with a tapered nose onto a cable end of a wireline cable;

b. orienting the tapered nose to face in a direction opposite the cable end;

c. forming an assembly comprising:

(i) a pair of slidable cutting segment guides;

(ii) a pair of slidable cutting segments in a sliding engagement with the pair of slidable cutting segment guides;

(iii) a drive pinch cylinder positioned to provide a cable load to the slidable cutting segments, from an orientation opposite the tapered nose, the drive pinch cylinder comprising shear pin bore holes formed therein; and (iv) a pair of radially biased spring mechanisms disposed between the slidable cutting segments;

d. inserting the formed assembly into a lower housing having housing holes;

e. aligning the shear pin bore holes with the housing holes;

f. inserting at least one shear pin of a plurality of shear pins into each pair of aligned holes through the lower housing to a bottom of the shear pin bore holes;

h. torquing together the upper housing with the lower housing;

i. inserting a linear biasing mechanism and a disc into the lower housing through an end of the lower housing opposite the upper housing;

j. threading a tapered sleeve onto the cable end;

k. passing the cable end through a sliding bell;

l. unwinding cable strands from the cable end;

m. positioning the cable strands around a lower body of the sliding bell;

n. inserting the cable strands into bell holes in a bell top face of the sliding bell;

o. pulling the wireline cable causing the sliding bell to slide into the tapered sleeve and seat tightly to position the slidable cutting segments in an open non-cutting orientation around the wireline cable; and p. attaching the cable head with the cable shear mechanism to cut the wireline cable to a tool string for use downhole in a well.

2. The method of claim 1, further comprising:

a. applying the cable load to the wireline cable;

b. pulling the sliding bell into the tapered sleeve using the cable load;

c. using the cable load on the tapered sleeve to urge the linear biasing mechanism to apply the cable load onto the drive pinch cylinder to break the plurality of shear pins installed in the drive pinch cylinder;

d. continuing to supply the cable load to the drive pinch cylinder to urge the pair of slidable cutting segments toward the tapered nose along the pair of slidable cutting segment guides;

e. orienting cutting faces of the pair of slidable cutting segments to impact the wireline cable;

f. urging the pair of slidable cutting segments to move the cutting faces from an open position to a closed position cutting the wireline cable; and g. pulling the cable head with the cable shear mechanism out of the wellbore while detaching from the oilfield equipment left in the wellbore.

3. The method of claim 1, further comprising using the cable head with the cable shear mechanism for attaching to the wireline cable to support the oilfield equipment in the wellbore, the cable head with the cable shear mechanism comprising:

a. the housing with a cable bore having a central axis;

b. the tapered sleeve with a tapered sleeve cable bore within the housing;

c. the sliding bell with a sliding bell cable bore disposed within the housing, wherein the sliding bell cable bore receives the cable end of the wireline cable and pinches together a plurality of cable strands of the cable end between the tapered sleeve and the sliding bell when the sliding bell is pulled by the wireline cable into the tapered sleeve;

d. the drive pinch cylinder positioned in the housing;

e. the linear biasing mechanism positioned in the housing between the tapered sleeve and the drive pinch cylinder;

f. the plurality of shear pins, each shear pin disposed partially into the housing and through the drive pinch cylinder to a shear pin bore hole;

g. the pair of slidable cutting segments within the housing, each slidable cutting segment having a sliding surface, each slidable cutting segment having a cutting face, wherein the pair of slidable cutting segments slide from an open non-cutting orientation to a closed cutting orientation when the cable load exceeds a shear strength of the plurality of shear pins; and h. the pair of slidable cutting segment guides in the housing, each slidable cutting segment guide having a sliding guide surface for interfacing in a sliding engagement with one of the slidable cutting segments sliding surfaces, wherein when the cable load exceeds a preset limit, the plurality of shear pins shear allowing the slidable cutting segments to be moved up the slidable cutting segment guides to impact and shear the cable aided by the linear biasing mechanism.

4. The method of claim 3, wherein the cable head with the cable shear mechanism uses a spring as the linear biasing mechanism and the spring adapted to support at least 800 pounds.

5. The method of claim 3, wherein the cable head with the cable shear mechanism uses from 2 shear pins to 8 shear pins to straddle the housing and the drive pinch cylinder where the two parts contact.

6. The method of claim 3, wherein the cable head with the cable shear mechanism uses shear pins, each having a diameter from 0.125 inch to 0.5 inches.

7. The method of claim 3, wherein the cable head with the cable shear mechanism has a first group of the shear pins which have a first diameter and at least one of: a second group of the shear pins which have a second diameter or a second group of the shear pins which have a second diameter and a third group of the shear pins which have a third diameter.

8. The method of claim 3, wherein the cable head with the cable shear mechanism uses cutting faces having semi-circular shapes.

9. The method of claim 3, wherein the cable head with the cable shear mechanism uses sliding surfaces with an angle having a slope from 10 degrees to 30 degrees from the central axis.

10. The method of claim 3, wherein the cable head with the cable shear mechanism uses a grease loading port to load grease into the housing and a grease excess outlet allowing grease to be removed from the housing.

11. The method of claim 3, wherein the cable head with the cable shear mechanism uses a sliding disc located between the linear biasing mechanism and the tapered sleeve for supporting the linear biasing mechanism until the tapered sleeve applies pressure to the linear biasing mechanism.

12. The method of claim 3, wherein the cable head with the cable shear mechanism uses the tapered sleeve with an interior tapered surface sloped at an angle from 5 degrees to 15 degrees from the central axis.

13. The method of claim 3, wherein the cable head with the cable shear mechanism cuts the wireline cable having from 12 strands to 24 strands.

14. The method of claim 3, wherein the cable head with the cable shear mechanism uses the drive pinch cylinder that is tubular with an inner bore greater than a diameter of the wireline cable and the drive pinch cylinder slidable by the linear biasing mechanism upon the breaking of the plurality of shear pins.

15. The method of claim 3, wherein the cable head with the cable shear mechanism uses the plurality of shear pins, each having a shear pin length from ⅜ inch to ¾ inch.

16. The method of claim 3, wherein the cable head with the cable shear mechanism uses the plurality of shear pins that extend a shear pin length from 50 percent to 80 percent into the drive pinch cylinder.

17. The method of claim 3, wherein the cable head with the cable shear mechanism uses a plurality of first flutes disposed on an exterior portion of the housing, wherein each first flute has a depth from 0.01 inches to 0.06 inches and each first flute has a length from 1.25 inches to 1.50 inches, and wherein the plurality of first flutes are formed equidistantly around the housing.

18. The method of claim 3, wherein the cable head with the cable shear mechanism uses as the housing, the upper housing threaded to the lower housing, wherein the upper housing contains the pair of slidable cutting segments and the pair of slidable cutting segment guides and the lower housing contains the tapered sleeve, the sliding bell, the drive pinch cylinder, the linear biasing mechanism, and the plurality of shear pins disposed partially into the housing and through the drive pinch cylinder into the shear pin bore holes.

19. The method of claim 3, wherein the cable head with the cable shear mechanism uses with the pair of slidable cutting segments, the pair of radially based spring mechanisms separating the slidable cutting segments under static conditions prior to breaking of the plurality of shear pins.

* * * * *